US009132307B2

(12) United States Patent
Chen

(10) Patent No.: US 9,132,307 B2
(45) Date of Patent: Sep. 15, 2015

(54) TRAMPOLINE SWINGSET SUSPENSION

(76) Inventor: Samuel Chen, Shanghai (CN)

( * ) Notice: Subject to any disclaimer, the term of this patent is extended or adjusted under 35 U.S.C. 154(b) by 359 days.

(21) Appl. No.: 13/618,159

(22) Filed: Sep. 14, 2012

(65) Prior Publication Data

US 2014/0080674 A1 Mar. 20, 2014

(51) Int. Cl.

| | |
|---|---|
| ***A63B 5/11*** | (2006.01) |
| ***A63G 9/00*** | (2006.01) |
| ***A63G 9/14*** | (2006.01) |
| *A63B 71/02* | (2006.01) |
| *A63B 7/02* | (2006.01) |
| *A63B 21/02* | (2006.01) |

(52) U.S. Cl.

CPC ... *A63B 5/11* (2013.01); *A63G 9/14* (2013.01); *A63B 7/02* (2013.01); *A63B 21/023* (2013.01); *A63B 71/022* (2013.01); *A63B 2208/12* (2013.01)

(58) Field of Classification Search

CPC ..... A63B 5/11; A63G 9/00
USPC ..... 482/27
See application file for complete search history.

(56) References Cited

U.S. PATENT DOCUMENTS 3,233,895 A * 2/1966 Grelle et al. ..... 482/27
7,909,738 B2 * 3/2011 Chen ..... 482/27

* cited by examiner

*Primary Examiner* — Stephen Crow
*Assistant Examiner* — Rae Fischer
(74) *Attorney, Agent, or Firm* — Clement Cheng

(57) ABSTRACT

A trampoline swingset suspension includes a trampoline frame having at least three legs. A trampoline bed is suspended from the trampoline frame. Springs connect between the trampoline bed and the trampoline frame to provide resilient restoring force for a user. The trampoline enclosure frame includes a plurality of vertical trampoline enclosure frame members. An enclosure net is mounted to the trampoline enclosure frame. A swingset frame is mounted to at least two of the at least three legs of the trampoline frame. A swing seat is suspended from the swingset frame. A spring suspension connects the swingset frame to the trampoline frame. The spring is a coil spring having an upper end bounded by an upper pin and the coil spring has a lower end bounded by a lower pin.

16 Claims, 5 Drawing Sheets

TRAMPOLINE SWINGSET SUSPENSION

FIELD OF THE INVENTION

The present invention is in the field of backyard sports equipment, namely trampolines and swingsets.

DISCUSSION OF RELATED ART

Traditional trampolines did not have enclosures. Recently, enclosures have become the industry standard. Trampolines now incorporate a variety of different features. Inventor Samuel Chen combined a trampoline with a swing set as described in U.S. Pat. No. 7,909,738 issued Mar. 22, 2011, entitled trampoline swingset, the disclosure of which is incorporated herein by reference. The present invention is an improvement over the previous trampoline swingset.

SUMMARY OF THE INVENTION

A trampoline swingset suspension includes a trampoline frame having at least three legs. A trampoline bed is suspended from the trampoline frame. Springs connect between the trampoline bed and the trampoline frame to provide resilient restoring force for a user. The trampoline enclosure frame includes a plurality of vertical trampoline enclosure frame members. An enclosure net is mounted to the trampoline enclosure frame. A swingset frame is mounted to at least two of the at least three legs of the trampoline frame. A swing seat is suspended from the swingset frame. A spring suspension connects the swingset frame to the trampoline frame. The spring is a coil spring having an upper end bounded by an upper pin and the coil spring has a lower end bounded by a lower pin.

The swingset frame has a swingset outside rail structurally connecting the pair of swingset feet. The swingset frame has a pair of enclosure swingset vertical members that form a part of the trampoline enclosure frame. The trampoline enclosure frame can be formed as a plurality of arches. The trampoline swingset junction connector bolt connects an apex of the swingset frame to a swing swivel. A swing seat is suspended from the swing swivel portion of the swingset frame. The swingset frame has a pair of swing set feet located at an outside direction of the trampoline frame. The pair of swingset feet each have a swingset foot spring suspension. The spring is a coil spring having an upper end bounded by an upper pin and the coil spring has a lower end bounded by a lower pin. The spring suspension is located within a hollow portion of the trampoline enclosure frame, and the spring provides a generally vertical force.

Figure 1:
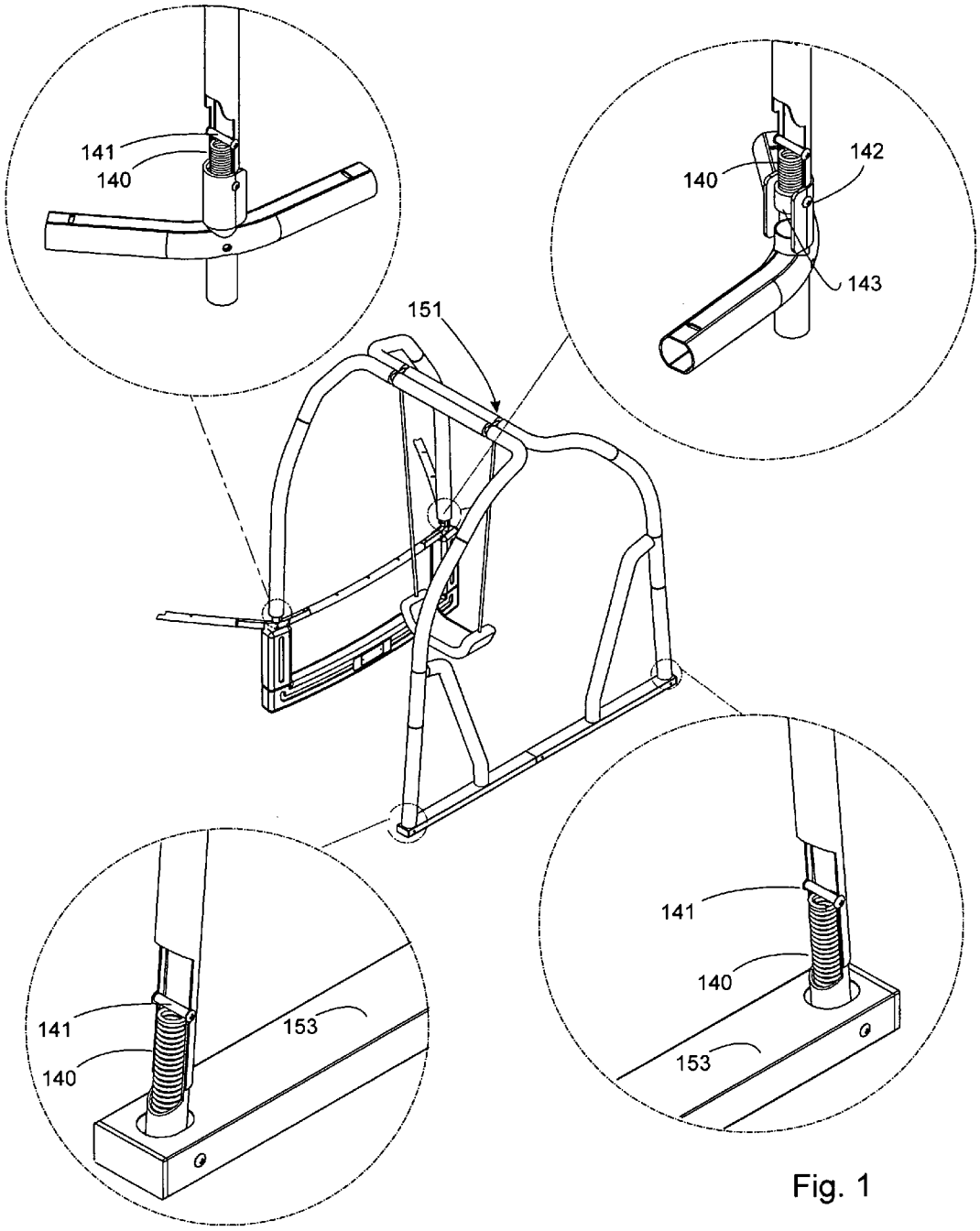
FIG. 1 is an assembled view of the swing assembly showing the spring suspension in broken view.
Figure 2:
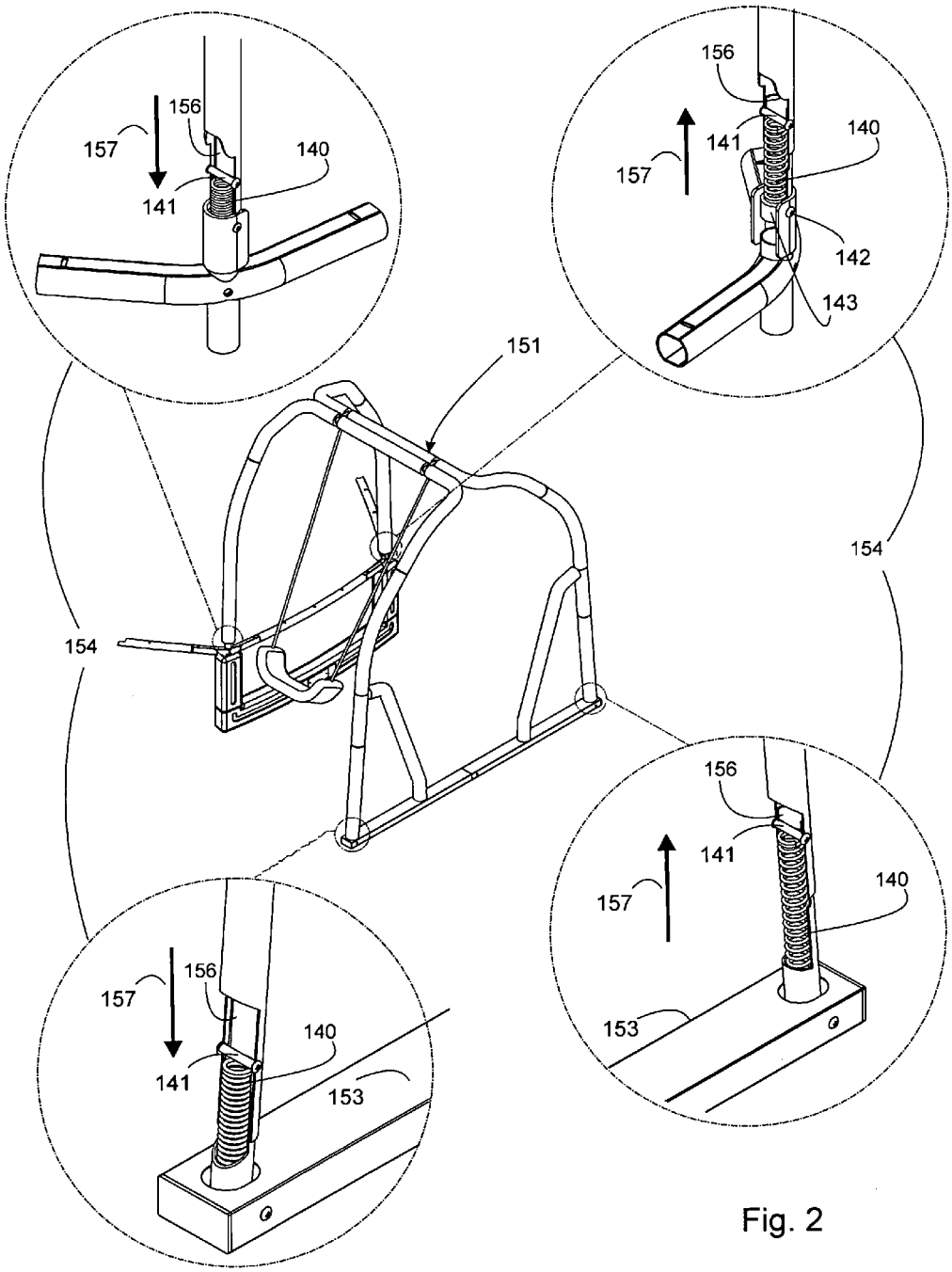
FIG. 2 is an assembled view of the swing assembly showing the spring suspension in broken view when the swing is swinging to the left.
Figure 3:
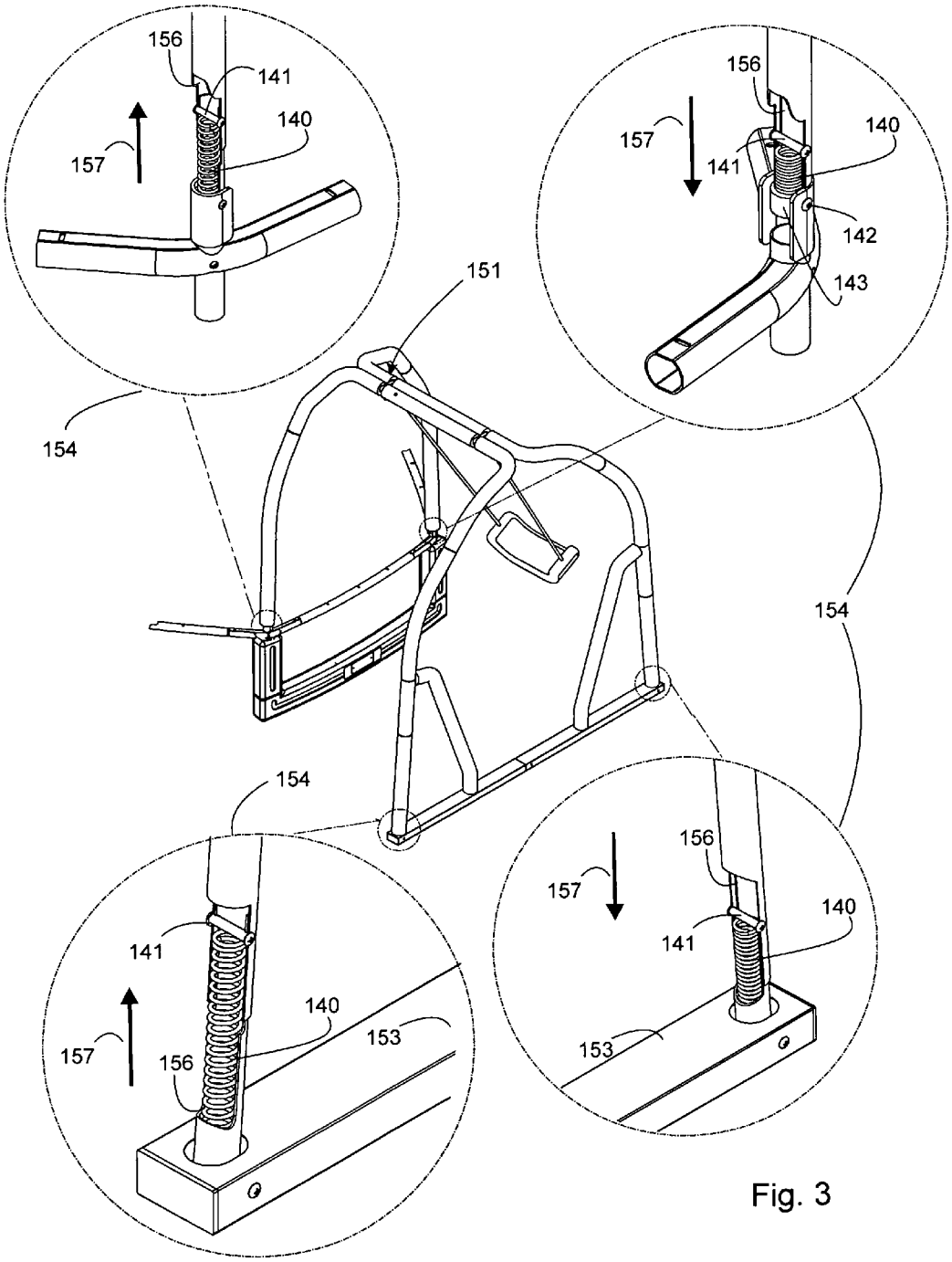
FIG. 3 is an assembled view of the swing assembly showing the spring suspension in broken view when the swing is swinging to the right.
Figure 4:
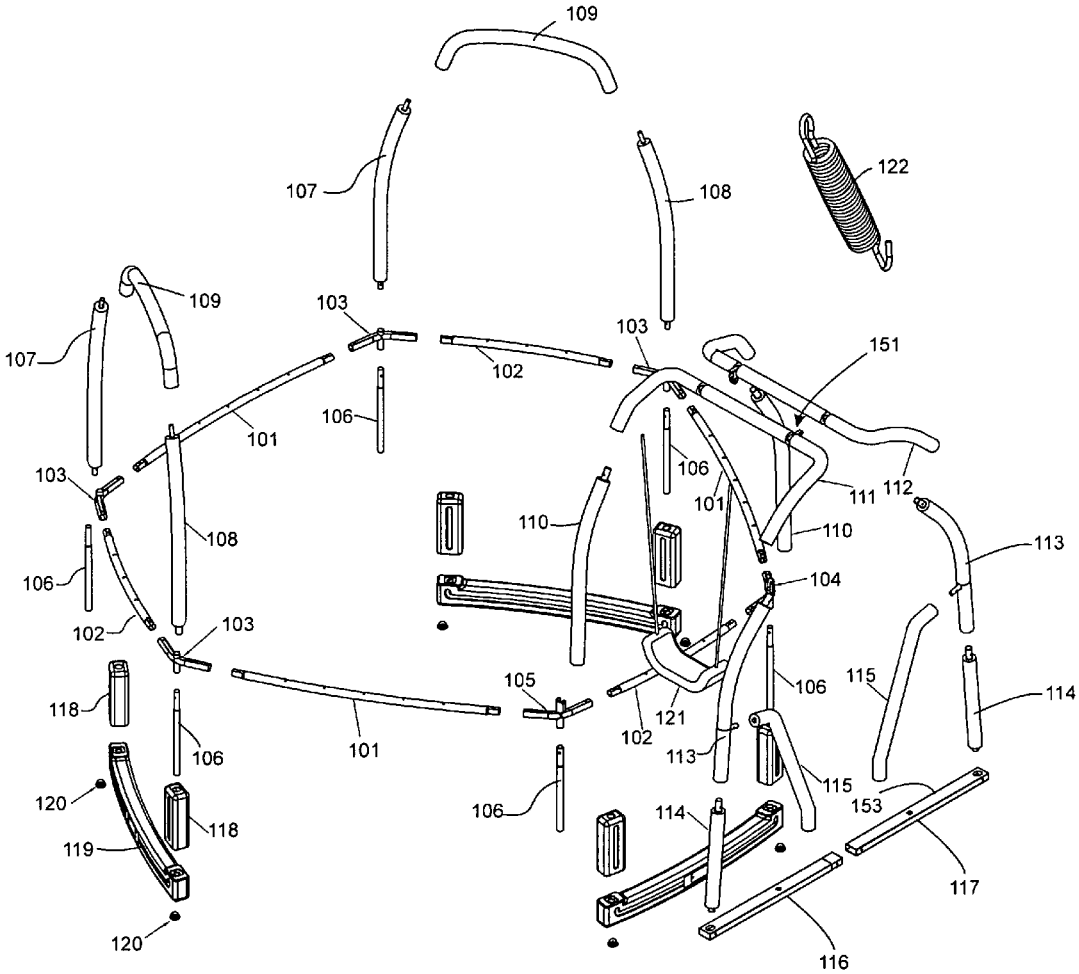
FIG. 4 is an exploded view of the present invention with the spring 122 enlarged.

The following call out list of elements is a useful guide in referencing the elements of the drawings.

101 Trampoline Frame Long Horizontal Member
102 Trampoline Frame Short Horizontal Member
103 Trampoline Frame Junction Connector
104 Trampoline Swingset Right Junction Connector
105 Trampoline Swingset Left Junction Connector
106 Trampoline Frame Vertical Member
107 Enclosure First Vertical Member
108 Enclosure Second Vertical Member
109 Enclosure Horizontal Member
110 Enclosure Swingset Vertical Member
111 First Swingset Apex Member
112 Second Swingset Apex Member
113 Swingset Outside Upper Vertical Member
114 Swingset Outside Lower Vertical Member
115 Swingset Outside Reinforcing Member
116 Swingset Outside Left Rail
117 Swingset Outside Right Rail
118 Trampoline Frame Vertical Member Cover
119 Trampoline Frame Base Rail
120 Trampoline Frame Base Rail Cap
121 Swing
122 Trampoline Bed Spring
123 Trampoline Swingset Junction Connector Bolt
124 Enclosure Swingset Horizontal Member Connection Screw
125 Swingset Outside Reinforcing Member Connection Pin
126 Swingset Outside Vertical Member Connection Pin
127 Enclosure Swingset Vertical Member Connection Pin
128 Swingset Outside Rail Connection Pin
129 Swingset Outside Reinforcing Member Lower Connection Bolt
130 Swingset Apex Connection Bolt
131 Swing Swivel Connection Bolt
132 Hex Tool
133 Spring Pulling Device
134 Screwdriver Tool
135 Small Screwdriver Tool
136 Small Wrench
140 Suspension Spring
141 Upper Pin
142 Lower Pin
143 Spring Retainer
151 Swing Swivel
152 Pair Of Swingset Feet
153 Rail
154 Swingset Foot Spring Suspension
156 Hollow Portion Of Trampoline Enclosure Frame
157 Generally Vertical Force

DETAILED DESCRIPTION OF THE PREFERRED EMBODIMENT

A trampoline with a swingset has a trampoline frame, an enclosure, a trampoline bed and a trampoline swingset. Although a variety of different trampoline structures can be implemented, a trampoline frame having a three legged configuration is shown in the drawings and specification. Each leg of the frame has a pair of vertical members connected by a horizontal member. Each loop of the enclosure has a pair of vertical members connected by horizontal member. Here, the loops of the enclosure are formed as arches.

The trampoline frame as a general circular ring shape made from tubular steel members. The trampoline frame supports a trampoline bed which is held by springs. To assemble the trampoline frame, trampoline frame long horizontal members 101 and the trampoline frame short horizontal members 102 are connected together at the trampoline frame junction connectors 103. Also, a trampoline swingset right junction connector 104 and a trampoline swingset left junction connector 105 are connected to the generally circular trampoline frame.

Six trampoline frame vertical members 106 attach to the trampoline frame junction connectors. The trampoline frame vertical members can insert into a socket of the trampoline frame junction connectors. Similarly, the trampoline frame junction connectors can have a left and right socket for receiving for a trampoline frame short horizontal members and the trampoline frame long horizontal members. Each pair of trampoline frame vertical members is used for forming a leg.

The enclosure is formed of an enclosure first vertical member 107 and an enclosure second vertical member 108 with an enclosure horizontal member 109 extending between the enclosure first vertical member and the enclosure second vertical member.

The swingset frame and the trampoline frame are integral. A swingset frame is smaller and has a smaller footprint than the trampoline frame. The swingset frame and the trampoline frame overlap at at least one of the legs where the swingset frame forms a portion of the enclosure. As part of the enclosure, the enclosure swingset vertical members 110 provide an enclosure frame to hold a net. The net provides a safety restraint for users.

The apex of the swingset is the higher area of the swingset frame from which the swing is suspended. The apex here is formed by attaching a first swingset apex member 111 to the enclosure swingset vertical member. The enclosure swingset vertical member is in turn mounted to the trampoline swingset junction connector. The second swingset apex member 112 similarly is connected to the enclosure swingset vertical member that is connected to the trampoline swingset right junction connector.

The swingset outside upper vertical member 113 is connected to the swingset outside lower vertical member 114 to form a swingset outside vertical member. The swingset outside vertical member is connected to the swingset outside reinforcing member 115, which in turn is connected to the swingset outside rail. The swingset outside rail can be assembled by connecting the swingset outside left rail 116 to the swingset outside right rail 117. The swingset outside left rail may have a socket connection with the swingset outside right rail.

The leg of the trampoline also includes a trampoline frame vertical member cover 118 for covering the trampoline frame vertical member. A trampoline frame base rail 119 connects the pairs of trampoline frame vertical members. The trampoline frame base rail can have a plastic cover over a tube of reinforcing steel inside the plastic cover. Optionally, the trampoline frame vertical member rests on the trampoline frame base rail 119. The trampoline frame base rail can be plastic injection molded with a pair of openings that are sealed by a number of trampoline frame base rail caps 120.

The final step of assembly to install or hang a swing 121 to the apex area of the swingset frame. A user must install a number of trampoline bed springs 122 to pull the frame of the trampoline together around the trampoline bed.

A variety of different key connections are suggested in assembling the trampoline swingset. The trampoline swingset junction connector bolt 123 passes through each of the six junction connectors. The six junction connectors have an opening for receiving the swingset junction connector bolt. Four trampoline frame junction connectors, a trampoline swingset right junction connector and a trampoline swingset left junction connector are the six junction connectors. The junction connector opening is horizontally formed. The trampoline frame vertical members may have a horizontally formed opening that matches the junction connector horizontal opening. Preferably, the trampoline frame vertical members are secured to the junction connectors by a bolt such as the swingset junction connector bolt.

The swingset junction connector bolt can pass through the trampoline frame long horizontal member and the trampoline frame short horizontal member that are inserted into the sockets of the swingset junction connector bolt. The alternating nature of the long horizontal member in the short horizontal member provides that the long horizontal member be inserted to a left or right socket of the swingset junction connector. Similarly, the short horizontal member can be inserted into a left or right socket of the swingset junction connector opposing the long horizontal member.

The enclosure is preferably secured together by a set screw. Preferably, an enclosure swingset horizontal member connection screw 124 secures the enclosure vertical member to the enclosure horizontal member. The enclosure vertical member to the enclosure horizontal member may have a socket connection. After the enclosure swingset horizontal member connection screw is installed, a foam sleeve is preferably drawn over the enclosure vertical member and the enclosure horizontal member. The foam sleeve also preferably covers the location of the enclosure swingset horizontal member connection screw.

The swingset outside reinforcing member connection pin 125 provides a connection between the swingset outside reinforcing member and the swingset outside vertical member. The swingset outside vertical member may have a socket or protrusion for connecting to the swingset outside reinforcing member. Preferably, the swingset outside reinforcing member connection pin passes through the socket or protrusion of the swingset outside vertical member and also passes through the upper end of the swingset outside reinforcing member so as to secure them together.

The swingset outside vertical member connection pin 126 is similar to the other pins because it has a shaft portion that is smooth on the exterior but with a threaded tip to receive a bolt. The bolt and shaft portion comprise the pin. The swingset outside vertical connection pin connects the swingset outside upper vertical member to the swingset outside lower vertical member so as to form a swingset outside vertical member. A second swingset outside vertical connection member pin also makes a connection between the second swingset apex member and the swingset outside upper vertical member.

The enclosure swingset vertical member connection pin 127 makes connection between the trampoline swingset junction connector and the enclosure vertical members such as the enclosure first vertical member and the enclosure second vertical member. The junction connectors have a socket facing upward that receives the enclosure vertical members. Both the enclosure vertical members and the socket of the junction connectors are drilled or form with an opening to receive the enclosure swingset vertical member connection pins. If there are a total of six junction connectors, there will be a total of six enclosures swingset vertical member connection pins disposed in an upper portion of the junction connectors. The upper portion of the junction connectors can be formed as sockets that are at a higher level than the trampoline frame horizontal members.

The swingset outside rail connection pin 128 connects the pair of outside rail members together to form the outside rail. A swingset outside reinforcing member lower connection bolt 129 passes through a lower surface of the outside rail to secure the swingset outside reinforcing member to the outside rail.

Figure 5:
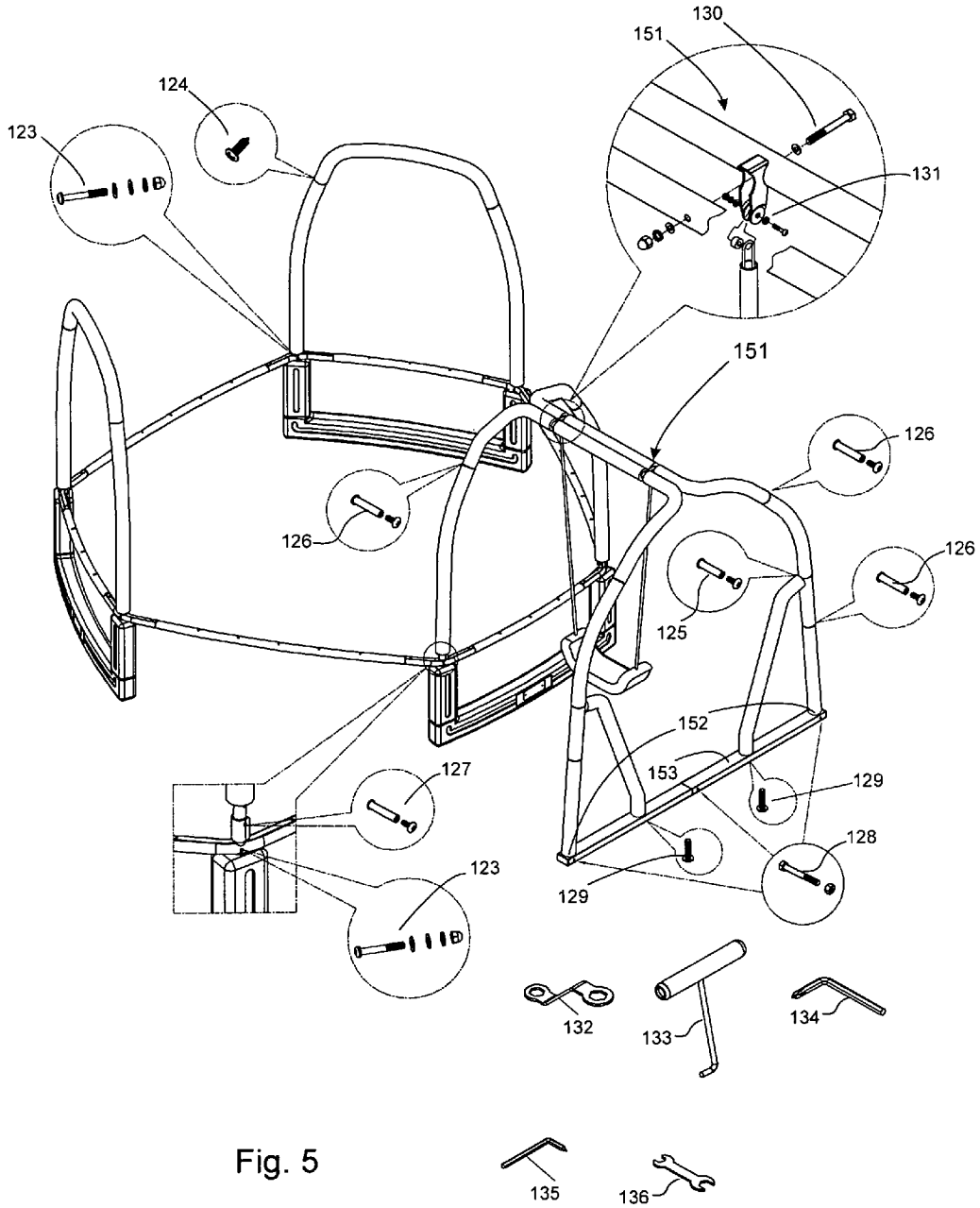
FIG. 5 is an assembly diagram showing hardware connection.

The top portion of the swingset is an apex that has a pair of parallel tubular members connected together by a swingset apex connection bolt 130. Perpendicular to the swingset apex connection bolt 130 is a swing swivel connection bolt 131. The swingset apex connection bolt secures the swing swivel between the pair of tubular members as seen in FIG. 5. The pair of tubular members may have round cross-section fitting into a narrow hourglass portion of the swing swivel. The swing swivel can be formed as a punched sheet of metal strip folded to have a pair of lower ends. The swing swivel can be formed as a bracket shown in the figure. The lower ends of the swing swivel are suspended from the apex of the swingset. The pair of lower ends of the swing swivel are connected together at the swing swivel connection bolt 131. Preferably, the swing swivel connection bolt passes through a link of a chain of the swing seat.

A variety of different tools can be used for assembling the trampoline frame. Preferably, some simple tools may be included with the trampoline frame. A hex tool 132 can be useful for securing nuts and a spring pulling device 133 may have a handle with a hook for grabbing ends of springs. Additionally, a screwdriver tool 134 and a small screwdriver tool 135 can be used with a small wrench 136 to tighten and assemble parts.

After assembly, the swingset is suspended on its legs and on the trampoline frame. Those swingset has preferably four suspension points, with two located at two lower ends of the enclosure swingset vertical member 110, and with two at lower ends of the swingset outside lower vertical members 114. The swingset suspension has both dampening and resilient forces. Preferably, a spring 140 is retained by a pin which provides telescopic movement toward countering high frequency vibrations and oscillations. The spring can be a coil spring having a diameter less than the tube of the frame so that the spring fits inside the frame. The spring is preferably retained at a spring upper end by an upper pin 141 and also preferably retained at a lower end by a lower pin 142. A spring retainer 143 may cover an end of the spring and also fit inside the tubular frame, or be in telescopic configuration with the tubular frame.

The swingset and trampoline both generate vibrations that can dampen each other through the mass spring system. The motion of the suspension spring within the trampoline frame also generates dampening friction. Dampeners may be added to the suspension spring for greater dampening control.

The invention claimed is:

1. A trampoline swingset suspension comprising:

a trampoline frame having at least three legs;

a trampoline enclosure frame comprising a plurality of vertical trampoline enclosure frame members;

an enclosure net mounted to the trampoline enclosure frame;

a trampoline bed suspended from the trampoline frame;

a plurality of springs connecting between the trampoline bed and the trampoline frame to provide resilient restoring force for a user;

a swingset frame mounted to at least two of the at least three legs of the trampoline frame;

a suspension spring positioned at the joint of the swingset frame and the trampoline frame, and configured to provide resilience to the joint; and a swing seat suspended from the swingset frame.

2. The trampoline swingset suspension of claim 1, wherein the suspension spring is a coil spring having an upper end bounded by an upper pin and wherein the coil spring has a lower end bounded by a lower pin.

3. The trampoline swingset suspension of claim 1, wherein the swingset frame has a swingset outside rail structurally connecting a pair of swingset feet, wherein the pair of swingset feet are mounted to the swingset frame.

4. The trampoline swingset suspension of claim 1, wherein the swingset frame has a pair of enclosure swingset vertical members of that form a part of the trampoline enclosure frame.

5. The trampoline swingset suspension of claim 1, wherein the trampoline enclosure frame is formed as a plurality of arches.

6. The trampoline swingset suspension of claim 1, wherein a swingset apex connection bolt connects an apex of the swingset frame to a swing swivel, wherein a swing seat is suspended from the swing swivel portion of the swingset frame.

7. The trampoline swingset suspension of claim 1, wherein the swingset frame has a pair of swingset feet located at an outside direction of the trampoline frame, wherein each of the swingset feet has a swingset foot suspension spring.

8. The trampoline swingset suspension of claim 1, wherein the suspension spring is a coil spring having an upper end bounded by an upper pin that is installed on the swingset frame and a lower end bounded by a lower pin that is installed on the trampoline frame.

9. The trampoline swingset suspension of claim 8, wherein the swingset frame has a swingset outside rail structurally connecting a pair of swingset feet, wherein the pair of swingset feet are mounted to the swingset frame.

10. The trampoline swingset suspension of claim 8, wherein the swingset frame has a pair of enclosure swingset vertical members of that form a part of the trampoline enclosure frame.

11. The trampoline swingset suspension of claim 8, wherein the trampoline enclosure frame is formed as a plurality of arches.

12. The trampoline swingset suspension of claim 8, wherein a swingset apex connection bolt connects an apex of the swingset frame to a swing swivel, wherein a swing seat is suspended from the swing swivel portion of the swingset frame.

13. The trampoline swingset suspension of claim 8, wherein the trampoline enclosure frame is formed as a plurality of arches and wherein the swingset frame has a pair of enclosure swingset vertical members that form a part of the trampoline enclosure frame.

14. The trampoline swingset suspension of claim 13, wherein the swingset frame has a swingset outside rail structurally connecting a pair of swingset feet, wherein the pair of swingset feet are mounted to the swingset frame.

15. The trampoline swingset suspension of claim 13, wherein a swingset apex connection bolt connects an apex of the swingset frame to a swing swivel, wherein a swing seat is suspended from the swing swivel portion of the swingset frame.

16. The trampoline swingset suspension of claim 13, wherein the suspension spring is located within the interior of the vertical trampoline enclosure frame members, and is configured in a generally vertical direction to absorb generally vertical forces.

* * * * *